United States Patent [19]

Cros

[11] Patent Number: 4,942,824

[45] Date of Patent: Jul. 24, 1990

[54] ARTICULATED COUPLING FOR TWO RAIL VEHICLES

[75] Inventor: Michel Cros, La Jarne, France

[73] Assignee: Societe Anonyme dite: Alsthom, Paris, France

[21] Appl. No.: 354,560

[22] Filed: May 22, 1989

[30] Foreign Application Priority Data

May 24, 1988 [FR] France ..... 88 06878

[51] Int. Cl.[5] ..... B61G 5/02

[52] U.S. Cl. ..... 105/4.3; 105/199.4; 213/75 R

[58] Field of Search ..... 105/3, 4.1, 4.3, 199.4; 213/1 R, 7, 75 R, 77

[56] References Cited

U.S. PATENT DOCUMENTS

| | | | |
|---|---|---|---|
| 1,851,702 | 3/1932 | Griffin | 105/4.1 |
| 2,051,958 | 8/1936 | Madison | 105/4.3 X |
| 2,150,896 | 3/1939 | Muchnic | 105/199.4 |
| 2,158,062 | 5/1939 | Blomberg | 105/4.1 |
| 3,667,820 | 6/1972 | Sherrick | 105/199.4 X |

FOREIGN PATENT DOCUMENTS

| | | |
|---|---|---|
| 0662477 | 10/1965 | Belgium . |
| 1218900 | 3/1987 | Canada . |
| 1094289 | 12/1960 | Fed. Rep. of Germany . |

*Primary Examiner*—Andres Kashnikow
*Assistant Examiner*—A. Muratori
*Attorney, Agent, or Firm*—Sughrue, Mion, Zinn, Macpeak & Seas

[57] ABSTRACT

An articulated coupling for two rail vehicles supported by a common bogie comprises: (A) a toroidal part (1) connected to one of the vehicles, said part being frusto-conical in its bottom zone and cylindrical in its top zone, and having a cylindrical ball in its center and a shoulder around the top thereof; and (B) a support part connected to the other vehicle, enveloping the toroidal part, and comprising a sole plate (9), a toroidal articulated coupling element made of resilient composite material, a cylindrical peg (17) fixed to the sole plate, engaged in the ball of the toroidal part, and terminated by a horizontal shoulder; and an internal cylindrical part (20) facing the cylindrical external surface (3) of the toroidal part.

7 Claims, 3 Drawing Sheets

ARTICULATED COUPLING FOR TWO RAIL VEHICLES

The present invention relates to an articulated coupling for two rail vehicles supported on a common bogie having resilient supporting members.

BACKGROUND OF THE INVENTION

Current articulated couplings on a common bogie comprise a sole plate connected to one of the vehicles, supported on the common bogie by springs, and carrying a ball on elastomer members with the top surface of the ball bearing against a spherical bearing surface connected to the other vehicle. Such articulated couplings including spherical surfaces require a great deal of machining. They are expensive and relatively heavy.

Canadian Pat. No. CA-1 218 900 describes an articulated coupling for rail cars making use of a common bogie, in which the ends of the bodies of the two vehicles are pivotally mounted on the axis of a cylindroconical connection part which is connected by means of an annular part made of elastomer to a bowl on the bogie. This articulated coupling does not allow one of its parts to be at an angle relative to the vertical axis so as to enable one vehicle to tilt relative to the other when entering or leaving lengths of track which are banked, and when passing over humps and dips.

The object of the present invention is to provide an articulated coupling which is cheap, relatively lightweight, and which also provides the necessary functions, even when applied to high-speed trains. It should enable parts to rotate relative to each other so that the train can negotiate curved track, and it should also allow one of its parts to take up an angle relative to the vertical axis in order to enable one vehicle to tilt relative to the other. In addition to responding to traction and braking forces in normal operation, it must also respond to forces due to exceptional shocks, within predetermined limits. It must be possible to raise the common bogie by applying hoisting forces to the vehicles during re-railing operations. Coupling and decoupling must be capable of being performed quickly.

SUMMARY OF THE INVENTION

The articulated coupling of the invention comprises:

(A) a toroidal part connected to one of the vehicles, having a frustoconical surface in its bottom zone and being cylindrical in its top zone, said toroidal part including a cylindrical ball through its center and being provided with a horizontal circular shoulder around the top of its cylindrical ball; and (B) a support part connected to the other vehicle, enveloping the toroidal part and comprising:

(a) a sole plate at a lower level than the toroidal part;

(b) a toroidal articulated coupling element of resilient composite material built up from metal plates sandwiched between layers of resilient material resting on the sole plate and surrounding and in contact with the frustoconical outer surface of the toroidal part;

(c) a cylindrical peg fixed to the sole plate, engaged in the cylindrical ball of the toroidal part, being of smaller diameter than said ball and being terminated by a horizontal circular shoulder facing the horizontal circular shoulder of the toroidal part; and (d) in the top portion of its peripheral zone, an internal cylindrical part facing the cylindrical outside surface of the top zone of the toroidal part.

The coupling preferably also includes at least one of the following features:

the metal plates and the layers of material building up the toroidal articulated element are in the form of spherical sectors;

the layers of resilient material are provided with internal hollows disposed in such a manner that the articulated coupling element presents different radial stiffnesses in the longitudinal direction and the transverse direction;

the toroidal part is provided beneath a bottom plane face outside the toroidal articulated coupling element of the support part with safety pins engaging in facing forks fixed to said toroidal articulated coupling element;

the toroidal articulated coupling element is applied to the sole plate by means of a support part which is connected to the sole plate by means of a locking member; and the angle relative to the vertical of the frustoconical external surfaces of the toroidal part and of the toroidal articulated coupling element, and the clearance between the cylindrical ball of the toroidal part and the cylindrical peg of the support part are such as to enable the toroidal part and the support part to be coupled together even when the toroidal part faces the support part with a considerable degree of excentricity.

BRIEF DESCRIPTION OF THE DRAWINGS

An embodiment of the invention is described by way of example with reference to the accompanying drawings, in which.

DETAILED DESCRIPTION

Figure 1:
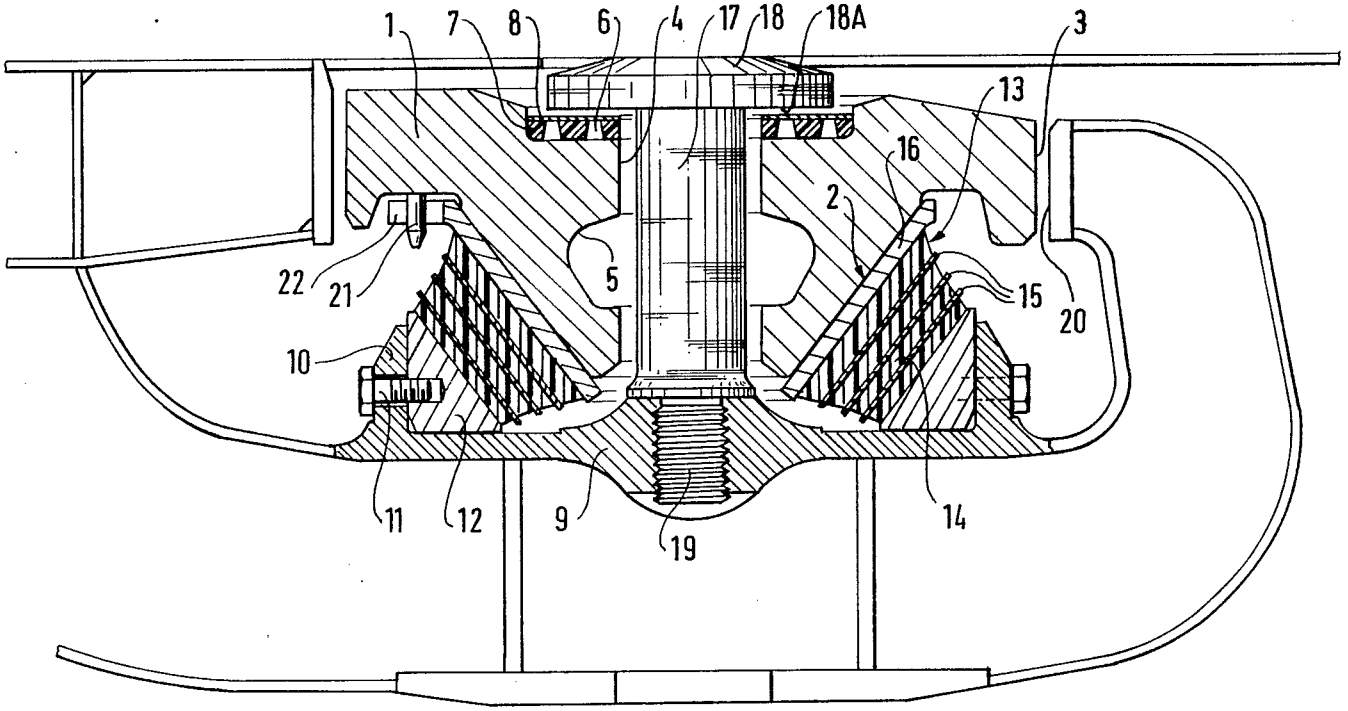
FIG. 1 shows an articulated coupling in section on a longitudinal plane of symmetry, with the contact-making surfaces of the toroidal part and the toroidal articulation element of the support part being frustoconical in shape.

In FIG. 1, the articulated coupling comprises a central toroidal part 1 connected to the body of one of the vehicles and having a frustoconical bearing surface 2 engaging a resilient toroidal articulated coupling element 13 made of composite material. Above the frustoconical bearing surface 2 there is an outer cylindrical surface 3 facing the outer cylindrical surface 20 of the sole plate 9 which is fixed to the body of the adjacent vehicle, but which is spaced apart therefrom.

The toroidal part has an axial ball 4 including a hollow 5 in the middle thereof. The middle of its top portion has a circular shoulder 6 provided with elastomer elements 7 supporting a circular steel ring 8 whose top surface is polished.

The sole plate 9 connected to the body of the adjacent vehicle is constituted by a plurality of elements which are welded to one another and comprises a cylindrical vertical rim 10 having a circular part 12 of triangular right cross-section fixed thereto by bolts such as 11 and supporting the composite toroidal coupling element 13. This element is built up of metal plates 14 sandwiched between layers of resilient material 15. A frustoconical plate 16 constitutes the bearing surface around the bottom portion of the toroidal part 1. This articulated coupling element may be constituted by a single part or it may comprise two or three parts.

A vertical peg 17 is fixed to the center of the sole plate 9 by virtue of a thread 19, with the vertical peg 17 being engaged in the ball 4 through the toroidal part 1 while leaving a large amount of clearance relative thereto. This clearance is large enough to ensure that the periphery of the peg does not make contact with the ball during normal longitudinal displacements in traction or in braking, and makes such contact only during exceptional shocks. The top portion of this peg has a circular cap 18 with a plane bottom surface 18A facing the circular ring of polished hard metal 8 on the toroidal part 1.

Safety pins 21 fixed to the toroidal central part 3 are engaged in forks 22 fixed to the toroidal element 13 so as to prevent any sliding between said part and the toroidal element, in particular when passing over small radius curves, while nevertheless allowing relative rotation.

Figure 2:
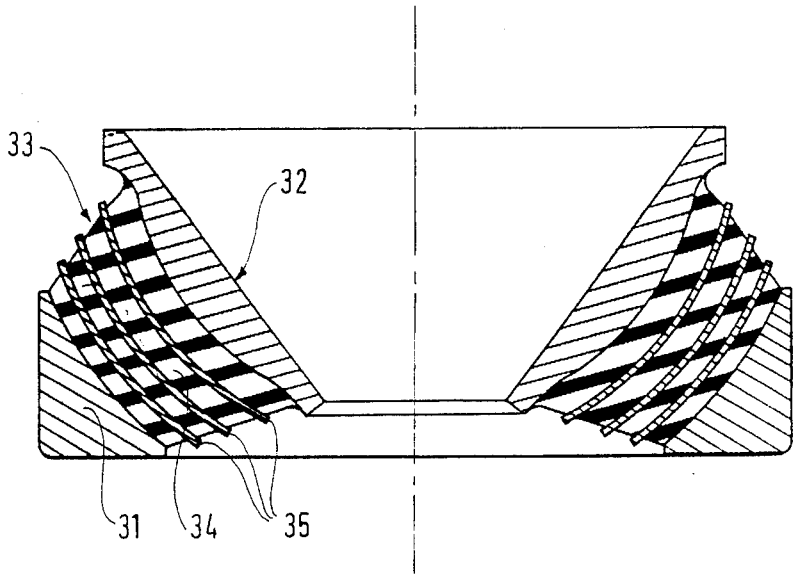
FIG. 2 shows a variant of the toroidal articulation element which is in the form of a spherical sector.

In the variant shown in FIG. 2 the layers of resilient material 34 and the metal plates 35 of the toroidal articulated coupling element 33 are in the form of spherical sectors as is the thrust face of the support part 13. The contact surface 32 with the central toroidal part (not shown) is frustoconical.

Figures 3, 4:
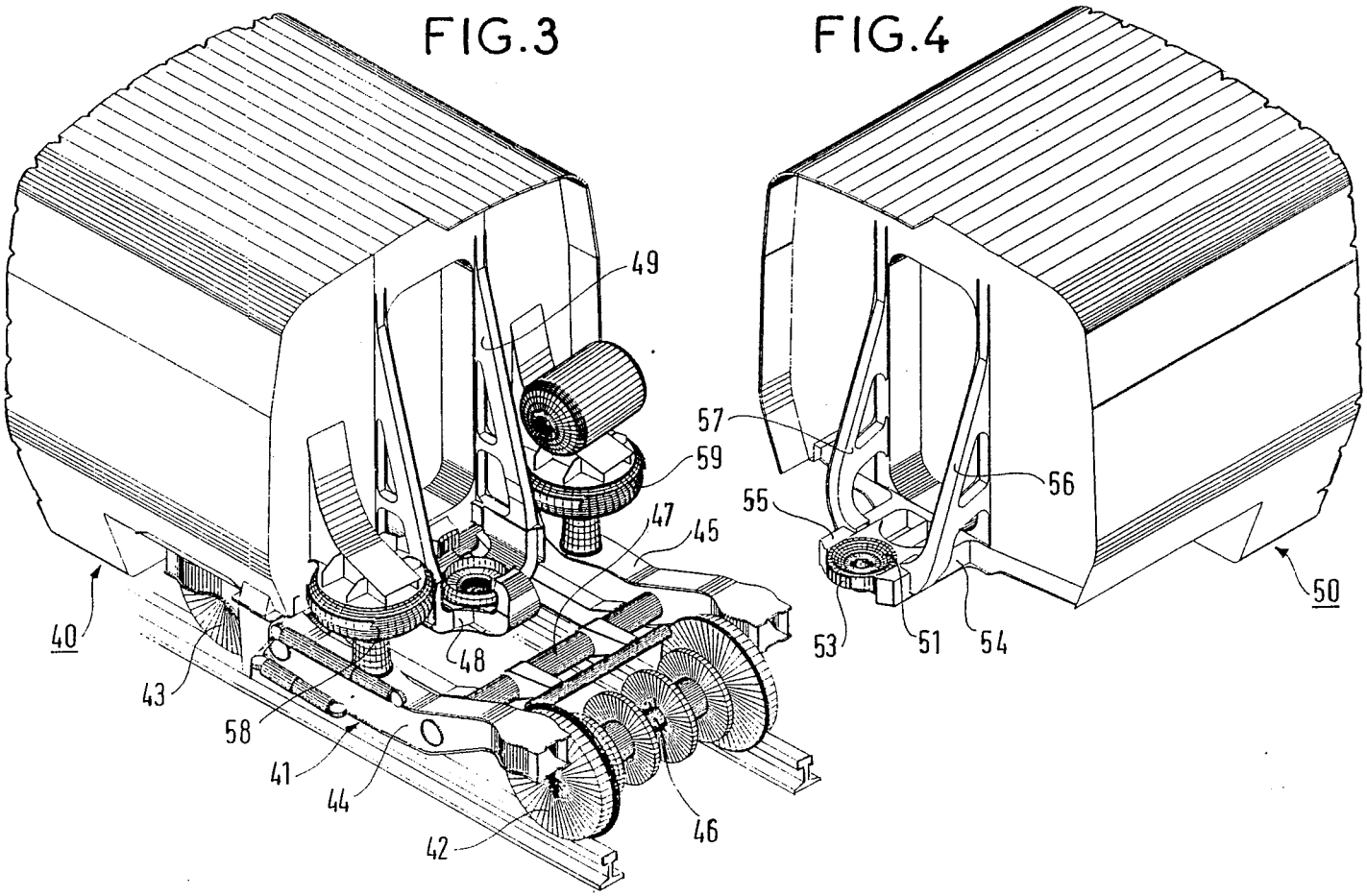
FIG. 3 is a perspective view of the end of a vehicle body together with the corresponding common bogie, also showing the support part of the articulated coupling with the body of the following vehicle.
FIG. 4 is a perspective view of the end of the following vehicle body with the toroidal articulated coupling part.

FIG. 3 shows the end of the body of one of the vehicles, together with the corresponding common bogie and the articulated coupling support part. The end 40 of the body is carried by the common bogie 41 which is supported by wheels such a 42 and 43, with only one of the axles 46 being visible. The axles are interconnected by longitudinal members 44 and 45 which are themselves held together by cross-members such as 47, and which support pneumatic suspension elements 58 and 59. The articulated coupling part 48 is supported by sloping arms 49 connected to the end face of the body.

FIG. 4 shows the end 50 of the body of the adjacent vehicle. The toroidal part 51 having an end cylindrical periphery 53 is carried by beams 54 and 55 connected to the end face of the body by sloping arms 56 and 57. When coupled, this part is received in the support part 48 of the adjacent body (FIG. 3).

I claim:

1. An articulated coupling for two rail vehicles supported by a common bogie between the two vehicles via resilient elements, wherein the coupling comprises:

(A) a toroidal part connected to one of the vehicles, having a frustoconical surface in its bottom zone and being cylindrical in its top zone, said toroidal part including a cylindrical ball through its center and being provided with a horizontal circular shoulder around the top of its cylindrical ball; and (B) a support part connected to the other vehicle, enveloping the toroidal part and comprising:

(a) a sole plate at a lower level than the toroidal part;

(b) a toroidal articulated coupling element of resilient composite material built up from metal plates sandwiched between layers of resilient material resting on the sole plate and surrounding and in contact with the frustoconical outer surface of the toroidal part;

(c) a cylindrical peg fixed to the sole plate, engaged in the cylindrical ball of the toroidal part, being of smaller diameter than said ball and being terminated by a horizontal circular shoulder facing the horizontal circular shoulder of the toroidal part; and (d) in the top portion of its peripheral zone, an internal cylindrical part facing the cylindrical outside surface of the top zone of the toroidal part.

2. An articulated coupling according to claim 1, wherein the metal plates and the layers of material building up the toroidal articulated element are in the form of spherical sectors.

3. An articulated coupling according to claim 2, wherein the layers of resilient material are provided with internal hollows disposed in such a manner that the articulated coupling element presents different radial stiffnesses in the longitudinal direction and the transverse direction.

4. An articulated coupling according to claim 1, wherein the layers of resilient material are provided with internal hollows disposed in such a manner that the articulated coupling element presents different radial stiffnesses in the longitudinal direction and the transverse direction.

5. An articulated coupling according to claim 1, wherein the toroidal part is provided beneath a bottom plane face outside the toroidal articulated coupling element of the support part with safety pins engaging in facing forks fixed to said toroidal articulated coupling element.

6. An articulated coupling according to claim 1 wherein the toroidal articulated coupling element is applied to the sole plate by means of a support part which is connected to the sole plate by means of a locking member.

7. An articulated coupling according to claim 1, wherein the angle relative to the vertical of the frustoconical external surfaces of the toroidal part and of the toroidal articulated coupling element, and the clearance between the cylindrical ball of the toroidal part and the cylindrical peg of the support part are such as to enable the toroidal part and the support part to be coupled together even when the toroidal part faces the support part with a considerable degree of excentricity.

* * * * *